US006002346A

United States Patent [19]

Bowden et al.

[11] Patent Number: 6,002,346

[45] Date of Patent: Dec. 14, 1999

[54] VEHICLE POSITIONING APPARATUS

[75] Inventors: Wesley E. Bowden; Evan L. Hopkins; Jerry L. Wedel, all of Emporia, Kans.

[73] Assignee: Pedestal Corporation, Emporia, Kans.

[21] Appl. No.: 09/223,671

[22] Filed: Dec. 30, 1998

[51] Int. Cl.[6] ..... B60Q 1/48

[52] U.S. Cl. ..... 340/932.2; 340/686.1; 340/933; 340/942; 340/988; 180/168

[58] Field of Search ..... 340/932.2, 933, 340/942, 958, 988, 431, 686.1; 180/168

[56] References Cited

U.S. PATENT DOCUMENTS 2,956,262 10/1960 Bahr .
4,665,378 5/1987 Heckethorn .
4,808,997 2/1989 Barkley et al. .
5,177,479 1/1993 Cotton .
5,208,586 5/1993 Friberg et al. .
5,285,205 2/1994 White .
5,623,259 4/1997 Giangardella .

*Primary Examiner*—Nina Tong
*Attorney, Agent, or Firm*—Hovey, Williams, Timmons & Collins

[57] ABSTRACT

A vehicle positioning apparatus (10) includes a sensor (34), light source (32) and adjustment mechanism (30). The light source (32) projects a light beam (192) toward a vehicle (196) when the sensor senses the operation of a garage door opener (16). When the vehicle (196) is in a desired parking location, the light beam (192) can be adjusted to hit a reference point on the vehicle. Thereafter, when pulling into the garage, the driver is signaled to stop when the light beam (192) reaches the predetermined reference point.

9 Claims, 2 Drawing Sheets

VEHICLE POSITIONING APPARATUS

BACKGROUND OF THE INVENTION

1. Field of the Invention

This invention relates to the field of motor vehicle accessories. More particularly, the invention is concerned with an apparatus for assisting a driver to properly position a vehicle during parking.

2. Description of the Prior Art

It is a common problem to park or otherwise position a vehicle accurately within the limited confines of a typical garage. Accurate positioning is necessary to prevent the front of the vehicle from hitting the end wall or objects placed on or along the end wall. It is also necessary to have adequate clearance at the rear of the vehicle to allow a garage door to close without hitting the vehicle.

Devices which assist drivers in parking or positioning vehicles are known, but generally are of a simple mechanical type. These devices require the vehicle to contact a mechanical element such as an arm, lever, switch, or ball. Although these devices are effective in their assistance of positioning a vehicle, they occupy floor and walking space in the garage. Other devices include complex circuitry that must be electrically connected to a garage door opener. These types of devices are expensive and typically more difficult to install.

A further problem with prior art vehicle positioning devices is that their positioning indicators either cannot be adjusted or such adjustment is time consuming and requires movement of a substantial portion of the device. There is therefore a need for a simple, economical, easy to install and easy to adjust positioning apparatus that does not require electrical connection to a garage door opener.

SUMMARY OF THE INVENTION

The present invention solves the problems mentioned above and provides a distinct advance in the state of the art. In particular, the vehicle positioning apparatus hereof does not require electrical connection to a garage door opener and is simple, economical, easily installed and easily adjusted.

The vehicle positioning apparatus of the present invention is configured for use with a conventional garage door opener and broadly includes a sensor and a light source. The sensor senses the operation of the garage door opener for triggering the light source. When triggered, the light source projects a light beam toward a specific, pre-determined spot in the garage and thereby signals a driver to stop his or her vehicle when the light beam reaches a predetermined position on the vehicle as it is driven in the garage.

In preferred forms, the light source is a laser. The apparatus may also include an adjustable mirror positioned to redirect the light beam toward the vehicle. The sensor in one preferred embodiment is a photoelectric cell that detects when a light on the garage door opener is lit. The sensor is placed on or near the garage door opener to reduce false initiations cause by overhead lights. In another preferred embodiment the sensor is a current transformer or other current sensing device that detects the flow of current to the garage door opener when it is in operation.

DETAILED DESCRIPTION OF THE PREFERRED EMBODIMENTS

Figure 1:
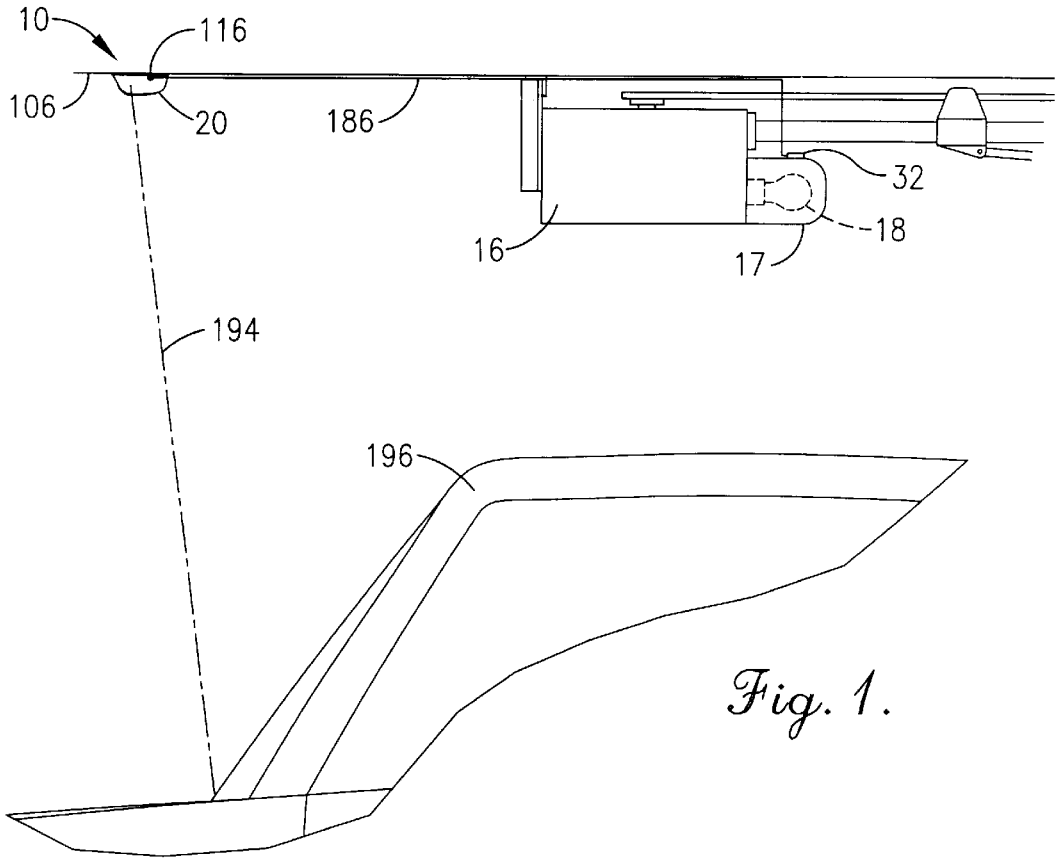
FIG. 1 is a schematic illustration of a vehicle positioning apparatus in accordance with the present invention shown mounted in a garage having a garage door opener.

The drawing figures illustrate a vehicle positioning apparatus 10 constructed in accordance with a preferred embodiment of the present invention. Referring initially to FIG. 1, the vehicle positioning apparatus 10 is shown mounted to the ceiling of a garage 12 including a garage door (not shown) and a garage door opener 16. The garage door opener 16 includes an electric motor (not shown), a light cover 17 and a light 18 which is lit when the electric motor begins operation.

As shown in FIGS. 2–5, the vehicle positioning device 10 includes a housing 20, a circuit board 26, a mirror 28, a mirror adjustment mechanism 30, a sensor 32 (FIG. 1) and a light source 34. The housing 20 includes two separate pieces, a base 22 and a cover 24. Preferably each is integrally formed and symmetrical about centerline 35.

Figure 2:
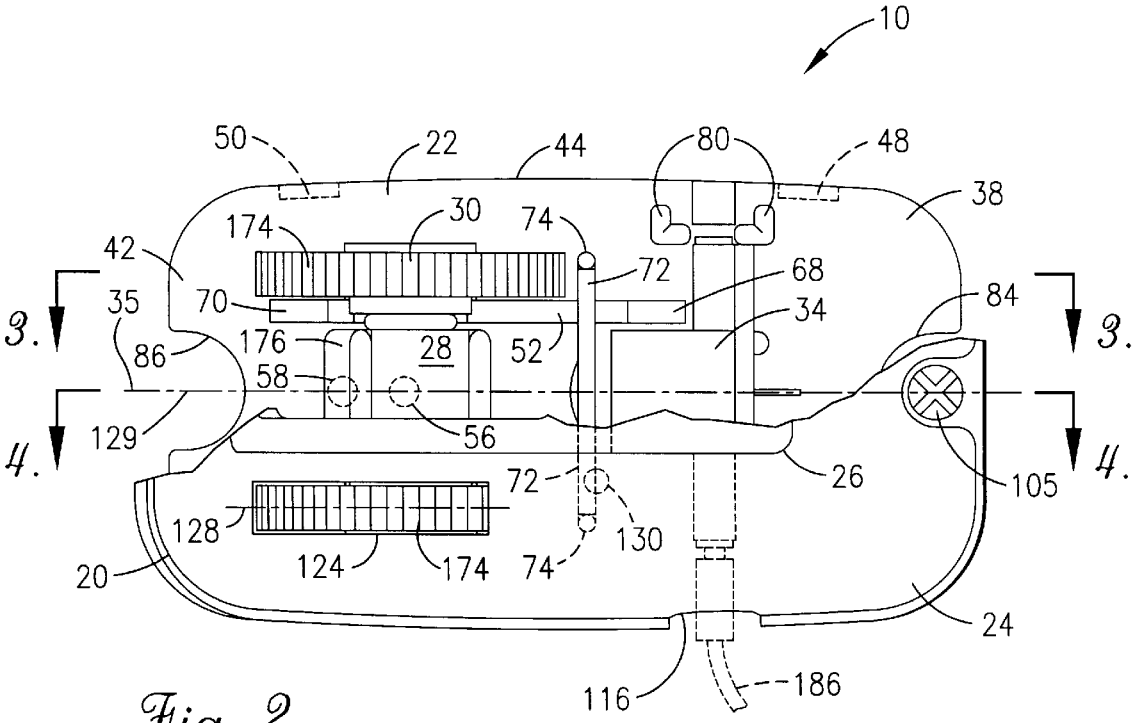
FIG. 2 is a top view of the apparatus.
Figure 5:
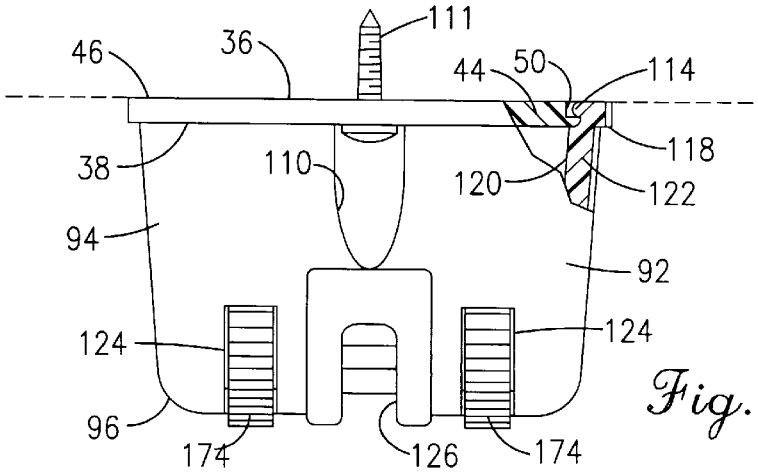
FIG. 5 is an end view of the apparatus.

Specifically referring to FIGS. 2 and 5, the base 22 includes a lower face 36, an upper face 38, a first end 40, a second end 42, a first side 44, and a second side 46. The lower face 36 of the base 22 includes a pair of first notches 48 and a pair of second notches 50. The first notches 48 are symmetrically spaced apart, and are located adjacent the first end 40, one on the first side 44 and one on the second side 46. (see FIG. 5) The second notches 50 are symmetrically spaced apart and are located adjacent the second end 42, one on the first side 44 and one on the second side 46.

Figure 4:
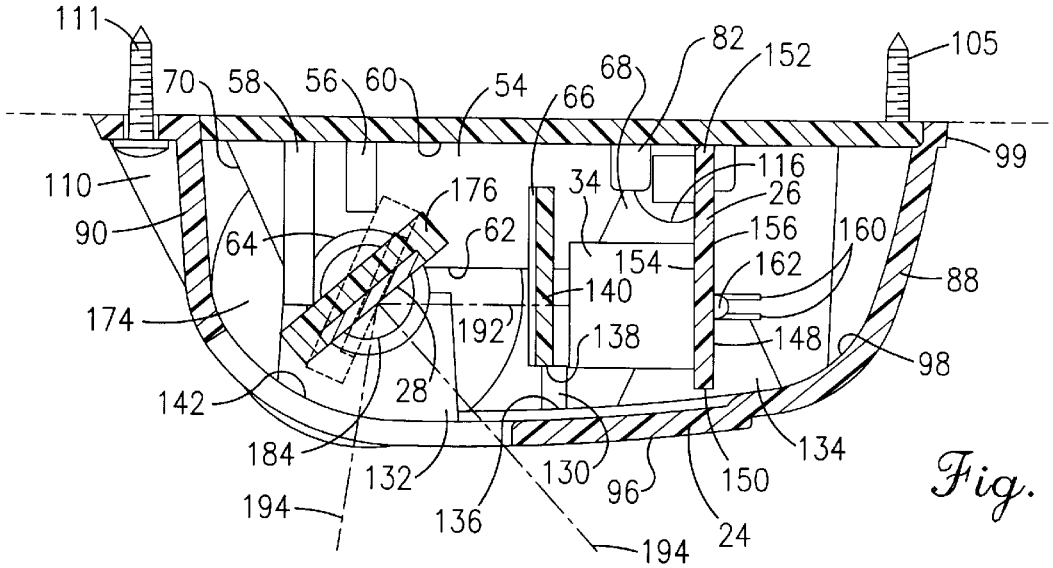
FIG. 4 is a side, vertical, sectional view taken along line 4—4 of FIG. 2 showing the apparatus attached to a support surface.

As shown in FIGS. 2 and 4, the upper face 38 of the base 22 includes a pair of spaced apart walls 52,54, a first mirror stop 56 and a second mirror stop 58. The walls 52,54 are symmetrical about centerline 35 and each includes a lower edge 60, an upper edge 62, a first angular end 68 and a second angular end 70. Each lower edge 60 is attached to the upper face 38. The upper edge 62 presents a semicircularly shaped portion 64 having structure defining a slot 66. The slot 66 is substantially adjacent the first angular end 68. The walls 52,54 are spaced apart sufficiently to allow the mirror 28 to fit between them. Each wall 52,54 further includes a supporting wall 72 and a retaining peg 74. The retaining peg 74 is substantially cylindrical and is attached to the upper face 38 of the base 22.

The first and second mirror stops 56,58 are formed from substantially tube-shaped members. The first mirror stop 56 is located on the centerline 35 of the base 22 between the lowest points of the semicircularly shaped portions 64 of the walls 52,54. The second mirror stop 58 is located on the centerline 35 of the base 22 at the portion of the upper edge 62 of the walls 52,54 nearest the second end 42 of the base 22. The first mirror stop 56 is comparatively smaller than the second mirror stop 58 and is nearer the first end 40 of base 22.

The upper face 38 further includes a first pair of posts 80 and a second pair of posts 82. The posts 80,82 are symmetrical about centerline 35. The posts 80,82 are L-shaped, with the first pair of posts 80 located on the first side 44 and the second pair of posts 82 located on the second side 46. The posts 80,82 bracket either side of each opening 116 in the cover 24. The circuit board 26 abuts one of each pair of posts 80,82.

The first end 40 of the base 22 includes a semicircularly shaped cutout 84 located symmetrically about centerline 35. The second end 42 of the base 22 includes a semicircularly shaped cutout 86 located symmetrically about centerline 35.

As shown in FIGS. 4 and 5, the cover 24 of housing 20 is preferably integrally formed and includes a first end 88, a second end 90, a first side 92, a second side 94, a top 96, a bottom 98, and a rim 99. The first end 88 includes structure about a centerline 35 defining a recessed channel 104 for receiving a fastener 105 and a tool (not shown) for inserting the fastener into a support surface 106. The second end 90 includes structure about the centerline 35 defining a recessed channel 110 for receiving a fastener 111 and a tool (not shown) for inserting the fastener into the support surface 106.

As shown in FIG. 5, the rim 99 extends along a lower margin 122 of the cover 24 and presents an opposed outer and inner edges 118,120. The first side 92 and second side 94 are symmetrical about the centerline 35. The inner edge 120 includes a first rib (not shown) and second rib 114 (FIG. 5) located along each of the sides 92,94. The first rib (not shown) is located adjacent the first end 88 of the cover 24 and the second rib 114 is located adjacent the second end 90 of the cover 24. The first and second ribs 112,114 are configured to be removably received in the first notch 48 and second notch 50 respectively.

Figure 3:
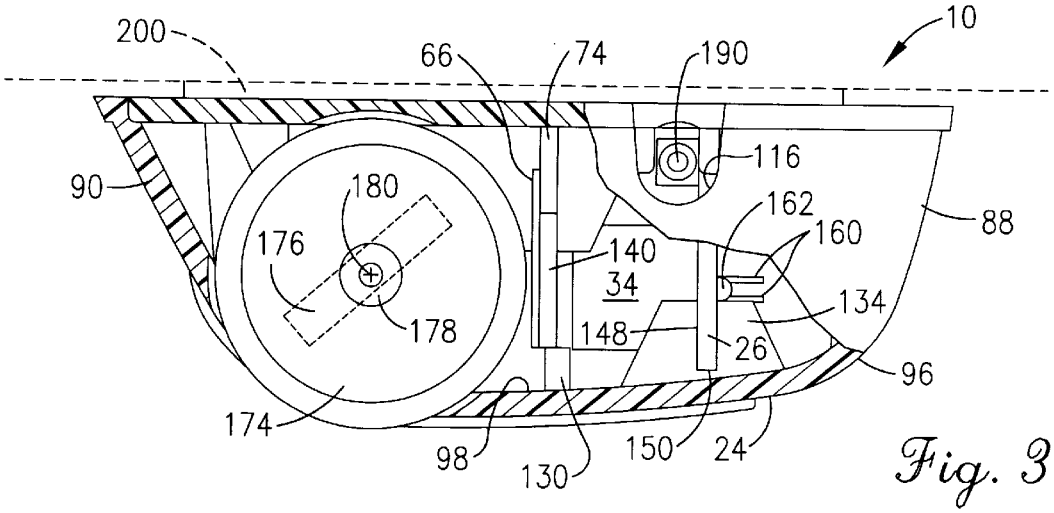
FIG. 3 is a side, vertical, sectional view taken along line 3—3 of FIG. 2 showing the apparatus attached to a support surface.

As shown in FIGS. 2 and 3, each side 92,94 further includes structure defining an opening 116 located adjacent the first rib (not shown). The opening 116 is generally arched shaped and allows access to the cover 24 once the ribs 112,114 are inserted into the notches 48,50.

The top 96, as illustrated in FIGS. 2 and 5, includes a pair of wheel slots 124 and a light aperture 126. Each wheel slot 124 is generally capsule-shaped and includes a long axis 128 substantially parallel to the centerline 35. The wheel slots 124 are symmetrical about centerline 35 and are spaced apart a substantially similar distance to the walls 52,54. The light aperture 126 is also generally capsule-shaped, but is comparatively larger than the two wheel slots 124. The light aperture 126 includes a long axis 129 which rests on top of the centerline 35. The light aperture 126 is adjacent the recessed channel 110.

As shown in FIGS. 3 and 4, the bottom 98 includes a pair of lens retaining members 130, a pair of retaining walls 132, and a pair of circuit board retaining members 134. Each lens retaining member 130 is a cylindrical nub having a first end 136 attached to the bottom 98 and a second end 138 configured to retain a lens 140. The retaining walls 132 each have a lower edge 142 and an upper edge 144. The upper edges 144 include a semicircularly shaped portion 146. The lower edges 142 attach to the cover 24.

The pair of circuit board retaining members 134 are each T-shaped and include a channel 148. The top portion of the T-shape is substantially parallel to the centerline 35. The channels 148 face each other on opposite sides of the centerline 35 and are configured to receive a top edge 150 of the circuit board 26.

The circuit board 26 includes a top edge 150, a bottom edge 152, a front face 154, and a back face 156. The bottom edge 152 is attached to the upper face 38 of the base 22. The light source 34 includes a pair of attachment members 160 which are inserted through a pair of openings (not shown) and a pair of fasteners 162 couple with the attachment members 160 to attach the light source 34 to the circuit board 26. The circuit board 26 further includes a delay circuit (not shown) which is operable to extinguish the light source after a predetermined amount of time after the garage door opener 16 has completed operation.

As shown in FIG. 1, the sensor 32 is positioned on or near the garage door opener 16, preferably on the light cover 17. In one preferred embodiment the sensor 32 is a light sensing device, preferably a photoelectric cell which senses when the garage door opener light 18 is lit. The garage door opener 16 usually has a delay circuit to delay extinguishing the light 18. Thus, if the garage door opener 16 includes a delay circuit (not shown) and a photoelectric cell type sensor 32 is used, the delay circuit (not shown) can be omitted from the circuit board 26. In another preferred embodiment the sensor 32 is an electricity sensing device such as a current transformer that senses when the garage door electric motor (not shown) is operating.

The sensor 32 is operably coupled with the light source 34. Both the sensor 32 and the light source 34 are electrically connected to the circuit board 26. Sensor 32 is connected with a sensor wire 186 entering through the opening 116 in the second side 94 of the cover 24. (see FIG. 2). A power source (not shown) is attached to the vehicle positioning apparatus 10 through the opening 116 in the first side 92 of the cover 24. The power source is preferably an electrical outlet connected to the apparatus 10 by a corresponding to electrical connecting device 190 which is attached to the first side 44 of the upper face 38 of the base 22. The electrical connecting device 190 is preferably a 120 VAC to 6 VDC transformer connected to the circuit board 26.

Referring again to FIG. 4, the light source 34 is preferably a low power laser device, but any light emitting device able to direct an intense beam of light 192 would be within the scope of the invention. The light source 34 is attached to the circuit board 26 by the fasteners 162 with the light emitting end directed toward the second end 42 of base 22 in a direction substantially parallel to the centerline 35.

The light source may also include the lens 140. The lens 140 is configured to be inserted into the slot 66 in the walls 52,54 where it is supported by the supporting walls 72 and is held in position by the lens retaining members 130. The sides of the lens 140 are retained by the support pegs 74 and are held in place by a friction fit, but alternative methods of fastening are within the scope of the invention. The lens 140 is preferably able to diffract the light beam 192 into a light line 194.

As shown in FIGS. 2, 3 and 4, the mirror adjustment mechanism 30 includes a pair of wheels 174, a mirror-receiving member 176 and an axle 178. The pair of wheels 174 each include a center 180, and a ledge 184. The ledge 184 is configured to rotatably couple with the semicircularly shaped portion 64 of the walls 52,54 of the base 22 and with the semicircularly shaped portion 146 of the retaining walls 132 of cover 24. The axle 178 extends through each wheel 174. The mirror-receiving member 176 is fixed to the axle 178. The mirror 28 is attached to the mirror-receiving member 176 using an adhesive such as glue. The mirror 28 faces toward the light source 34 at an angle to reflect the light beam 192 from the light source 34 toward the light aperture 126. The mirror adjustment mechanism 30 rotates about the axle 178 to selectively adjust the orientation of the mirror 28 to modify the direction of the light beam 192.

In use, the vehicle positioning apparatus 10 is assembled by placing the lens 140 into the slots 66 of the upper edges 62 of the walls 52,54. The ledges 184 of the mirror adjustment mechanism are placed on the semi-circular portions 64 of the upper edges 62 of the walls 52,54. Then the housing 24 is placed on top of the base, aligning the lens retaining members 130 with the lens 140 and the semi-circular portion 146 of the retaining walls 132 with the ledges 184 of the wheels 174. The sides 92,94 and the rim 99 of the housing 24 are resiliently yieldable to allow the ribs 112,114 to be slid over the upper face 38 of base 22 and be received within the corresponding notches 48,50.

The vehicle positioning apparatus 10 is mounted in a garage 12, preferably on the ceiling. The lower face 36 of the base 22 is placed adjacent the support surface 106. Instead of or in addition to the fasteners 105,111, two-sided pressure sensitive tape 200 (FIG. 3) is used to attach the apparatus 10 to the support surface 106. The sensor 32 is attached to a surface on or near the garage door opener light cover 17, preferably by adhesive tape, but other methods of attaching the sensor are within the scope of the invention. The sensor 32 is attached on the light cover 17 to reduce false initiations caused by turning on an overhead light or by other light sources. The sensor wire 186 runs between the housing 20 and the sensor 32 to attach the two electronically.

In operation, the sensor 32 sends a signal to the light source 34 when it senses the garage door opener 16 begin operation. This can be accomplished by sensing that the light 18 is lit, or by sensing electrical current corresponding to the operation of the electric motor (not shown). Once the vehicle positioning apparatus 10 receives the signal that the garage door 14 is being opened, it sends power to the light source 34.

The light source 34 emits a light beam 192 through the lens in the direction of the mirror 28 positioned adjacent the light source 34. The lens diffracts the light beam 192 into a light line 194. The light line 194 is redirected from the mirror 28, through the light aperture 126 and out of the vehicle positioning device 10. The light line 194 is projected onto a specific portion of the garage corresponding to a desired parking position 198. The light line 194 can be adjusted to a reference position on the vehicle 196 by selectively adjusting orientation of the mirror 28 by using the mirror adjustment mechanism 30 to modify the reflection angle of the mirror 28. One of the wheels 174 can be rotated to position the light line 194 on a reference position on the vehicle 196.

The mirror is limited in its rotation by the first and second mirror stops 56,58. The top of mirror 28 can be rotated toward the light source 34 until the mirror receiving member 176 contacts the first mirror stop 56. The top of the mirror can also be rotated away from the light source 34 until the mirror receiving member 176 contacts the second mirror stop 58. The angle of the mirror 28 at each stopping point corresponds with the one end of the light aperture 126, thereby assuring that the reflection angle will never be too large or too small to allow the light to flow from the aperture 126.

After the reference position on the vehicle is determined, any time a vehicle 196 is driven into the garage 12 and the light line 194 reaches a predetermined position on the vehicle 196 the operator knows the vehicle is in the desired parking position and should stop the vehicle 196. The light beam 192 gives the driver a predetermined position to adjust his or her vehicle 196 both laterally and longitudinally.

Those skilled in the art will now appreciate the benefits of the present invention. For example, the adjustment mechanism allows for simple modifications to the light beam 192 direction. This allows the user to quickly change the reference position without the use of any tools. Another benefit is simplicity of assembly and installation of the apparatus 10. The vehicle positioning apparatus can be installed into the ceiling of a garage 12 with two fasteners. The sensor can be mounted near the garage door opener 16 by simply placing it in a desired location. No wiring to the garage door opener 16 is required. The power source can be supplied by any standard outlet.

Those skilled in the art will also appreciate that the present invention encompasses many variations in the preferred embodiments described herein. The preferred embodiment uses a power transformer, but other types of power sources such as a battery could also be used. As another example, the preferred embodiment uses a lens to diffract the light beam into a light line, but the lens is not necessary for the invention. Further, a mirror is used to direct the light beam towards the vehicle, but the light beam could be mounted on the adjustable mechanism and positioned without reflection. Additionally, although a photoelectric cell and a current transformer are mentioned as sensor types, other sensors such as a motion detector would also be within the scope of the current invention.

Having thus described the preferred embodiments of the present invention, the following is claimed as new and desired to be secured by Letters Patent:

1. A vehicle positioning apparatus for signaling a driver of a vehicle when the vehicle has reached a desired parking position in a garage having a garage door opener, the apparatus comprising:

a base configured to be mounted above the desired parking position adjacent the garage door opener;

a sensor for sensing operation of the garage door opener;

a laser attached to the base and operably coupled with the sensor for projecting a light beam when the sensor senses operation of the garage door opener;

a mirror attached to the base for redirecting the light beam toward a predetermined location in the garage; and a mirror adjustment mechanism attaching the mirror to the base for selectively adjusting the orientation of the mirror to modify the direction of the light beam to the predetermined location in the garage.

2. The vehicle positioning apparatus of claim 1, the garage door opener further including a light that is lit when the garage door opener is in operation, wherein the sensor is a photoelectric cell which senses when the light is lit.

3. The vehicle positioning apparatus of claim 1, further including a delay circuit connected with the laser, for extinguishing the laser after a predetermined amount of time after the garage door opener has finished operation.

4. The vehicle positioning apparatus of claim 1, the garage door opener further including an electric motor, the sensing mechanism is a current transformer which senses when the garage door opener is operating.

5. A vehicle positioning apparatus for signaling a driver of a vehicle when the vehicle has reached a desired parking position in a garage having a garage door opener, the apparatus comprising:

a base configured to be mounted in the garage;

a sensor for sensing operation of the garage door opener;

a laser attached to the base and operably coupled with the sensor for projecting a light beam when the sensor senses operation of the garage door opener;

a mirror for redirecting the light beam toward a pre-determined location in the garage; and a mirror adjustment mechanism for selectively adjusting the orientation of the mirror to modify the direction of the light beam to the pre-determined location in the garage.

6. The vehicle positioning apparatus of claim 5, the garage door opener further including a light that is lit when the garage door opener is in operation, wherein the sensor is a photoelectric cell which senses when the light is lit.

7. The vehicle positioning apparatus of claim 5, further including a delay circuit connected with the laser, for extinguishing the laser after a predetermined amount of time after the garage door opener has finished operation.

8. The vehicle positioning apparatus of claim 5, the garage door opener further including an electric motor, the sensing mechanism is a current transformer which senses when the garage door opener is operating.

9. The vehicle positioning apparatus of claim 5, the adjustment mechanism being a wheel configured to selectively rotate the mirror.

* * * * *